US009719384B2

(12) United States Patent
Nishioka et al.

(10) Patent No.: US 9,719,384 B2
(45) Date of Patent: Aug. 1, 2017

(54) EXHAUST SYSTEM FOR INTERNAL COMBUSTION ENGINE

(71) Applicant: HONDA MOTOR CO., LTD., Tokyo (JP)

(72) Inventors: Makoto Nishioka, Wako (JP); Kenichiro Nakamura, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/249,586

(22) Filed: Aug. 29, 2016

(65) Prior Publication Data

US 2017/0074132 A1 Mar. 16, 2017

(30) Foreign Application Priority Data

Sep. 16, 2015 (JP) ..... 2015-183077

(51) Int. Cl.

| | |
|---|---|
| ***F01N 1/02*** | (2006.01) |
| ***G10K 11/16*** | (2006.01) |
| ***F01N 1/08*** | (2006.01) |
| *F01N 3/10* | (2006.01) |

(52) U.S. Cl.

CPC ..... *F01N 1/02* (2013.01); *F01N 1/083* (2013.01); *F01N 1/084* (2013.01); *F01N 1/089* (2013.01); *G10K 11/161* (2013.01); *F01N 3/10* (2013.01); *F01N 2470/02* (2013.01); *F01N 2470/14* (2013.01); *F01N 2470/16* (2013.01); *F01N 2490/02* (2013.01); *F01N 2490/14* (2013.01); *F01N 2590/04* (2013.01)

(58) Field of Classification Search

CPC ..... F01N 13/10; F01N 2470/14; F01N 1/084; F01N 1/089; F01N 3/10; F01N 1/02; G10K 11/161

USPC ..... 181/240, 227, 228, 238, 249, 251

See application file for complete search history.

(56) References Cited

U.S. PATENT DOCUMENTS

| | | | | | |
|---|---|---|---|---|---|
| 2,692,025 | A | * | 10/1954 | Maxim | F01N 1/08 181/238 |
| 3,388,768 | A | * | 6/1968 | Heath | F01N 1/00 181/266 |
| 3,388,769 | A | * | 6/1968 | Martoia | F02M 35/1227 156/87 |
| 4,408,675 | A | * | 10/1983 | Keller | F01N 13/04 180/296 |

(Continued)

FOREIGN PATENT DOCUMENTS

| | | |
|---|---|---|
| JP | 2014-137001 A | 7/2014 |

*Primary Examiner* — Forrest M Phillips

(74) *Attorney, Agent, or Firm* — Birch, Stewart, Kolasch & Birch, LLP

(57) ABSTRACT

An exhaust system for an internal combustion engine, configured to enhance a silencing effect while being miniaturized. The exhaust system includes a muffler body configured in such a manner that a first expansion chamber and a second expansion chamber separated from each other are partitioned therein. A plurality of exhaust pipes extend from an internal combustion engine and are connected to the first expansion chamber. A communication pipe is configured to be connected to the first expansion chamber and the second expansion chamber, to merge exhaust gas from the plurality of exhaust pipes, and to introduce the merged exhaust gas into the second expansion chamber.

13 Claims, 6 Drawing Sheets

(56) References Cited

U.S. PATENT DOCUMENTS

| | | | | |
|---|---|---|---|---|
| 8,028,798 | B2 * | 10/2011 | Koyanagi | F01N 1/003 181/212 |
| 8,220,587 | B2 * | 7/2012 | Mori | F01N 13/1811 181/211 |
| 2008/0000718 | A1 * | 1/2008 | Yasuda | F01N 1/00 181/227 |
| 2008/0236151 | A1 * | 10/2008 | Morita | F01N 13/08 60/324 |
| 2011/0186373 | A1 * | 8/2011 | Mori | F01N 13/08 180/219 |

* cited by examiner

EXHAUST SYSTEM FOR INTERNAL COMBUSTION ENGINE

CROSS-REFERENCE TO RELATED APPLICATIONS

The present application claims priority under 35 USC 119 to Japanese Patent Application No. 2015-183077 filed Sep. 16, 2015 the entire contents of which are hereby incorporated by reference.

BACKGROUND OF THE INVENTION

1. Field of the Invention

The present invention relates to an exhaust system for an internal combustion engine.

2. Description of Background Art

JP-A No. 2014-137001 discloses a motorcycle, such as a saddle-ride type vehicle. The motorcycle includes two mufflers connected to exhaust pipes of an internal combustion engine. The exhaust pipes of the internal combustion engine are provided with respect to each of cylinders, extend from a cylinder head, and are unified. Thereafter, the unified exhaust pipe is branched into two, and the two branched exhaust pipes are respectively connected to the mufflers. The two mufflers are housed in one exterior body.

In the above-described exhaust system, exhaust gas is distributed to individual mufflers. As a result, noise reduction is effectively achieved, and blowby of exhaust is improved. On the other hand, the two mufflers extend in parallel to each other. As a result, an enlargement of the exhaust system is unavoidable.

SUMMARY AND OBJECTS OF THE INVENTION

The present invention is designed in view of the above-mentioned circumstances. An object of an embodiment of the present invention is to provide an exhaust system for an internal combustion engine wherein the exhaust system being configured to improve a silencing effect while being miniaturized.

According to an embodiment of the present invention, an exhaust system includes a muffler body configured in such a manner wherein a first expansion chamber and a second expansion chamber separated from each other are at least partitioned therein, and a plurality of exhaust pipes, extending from an internal combustion engine, are connected to the first expansion chamber. A communication pipe is configured to be connected to the first expansion chamber and the second expansion chamber, to merge exhaust gas from the plurality of exhaust pipes, and to introduce the merged exhaust gas into the second expansion chamber.

According to an embodiment of the present invention, the muffler body is configured in such a manner wherein a third expansion chamber has only to be partitioned between the first expansion chamber and the second expansion chamber. A second communication pipe, in communicating with the second expansion chamber, with an outlet pipe penetrating through the second expansion chamber forms an exhaust port having only to be connected to the third expansion chamber.

According to an embodiment of the present invention, the exhaust system can further include a partition plate that is arranged inside of the first expansion chamber, that partitions the first expansion chamber with respect to each of the exhaust pipes in order to partition each individual space wherein an end surface is opposed to an inflow port of the communication pipe.

According to an embodiment of the present invention, the exhaust gas has only to be led to flow into the first expansion chamber from a plurality of cylinders of the internal combustion engine at different timings.

According to an embodiment of the present invention, the exhaust pipes have only to be passed through a catalytic device after being unified, and to be branched into the plurality of exhaust pipes at a downstream side of the catalytic device.

According to an embodiment of the present invention, the partition plate has only to be arranged in a position extending in parallel to an axial center of the communication pipe and bifurcating the inflow port of the communication pipe.

According to an embodiment of the present invention, the partition plate has only to be formed of curved plate material.

According to an embodiment of the present invention, the muffler body may be provided with a relief recessed part that is formed in a specified space occupied by a rear wheel when attached to a saddle-ride type vehicle and recessed toward the first expansion chamber, and one end of the partition plate has only to be welded to an inner wall surface of the relief recessed part.

According to an embodiment of the present invention, the exhaust gas from the internal combustion engine is introduced from the plurality of exhaust pipes into a single first expansion chamber. The exhaust gases are merged in the first expansion chamber, and are introduced into the second expansion chamber through a common communication pipe. For this reason, in comparison with the case that the muffler is formed with respect to each of the plurality of exhaust pipes, the exhaust system can be miniaturized. Also, after the exhaust gases are merged, the structure of the exhaust system is common between the plurality of exhaust pipes. For this reason, it contributes to reduce the number of components.

According to an embodiment of the present invention, the third expansion chamber is arranged. For this reason, when the first expansion chamber and the second expansion chamber are connected to each other, the communication pipe is penetrated through the third expansion chamber. As a result, a length of the communication pipe is ensured. The silencing effect is enhanced. In addition, the length of an exhaust gas flow path is further ensured by action of the outlet pipe. Thus, the silencing effect is further enhanced. The communication pipe and the outlet pipe are penetrated through the third expansion chamber and the second expansion chamber. For this reason, the miniaturization of the exhaust system is maintained.

According to an embodiment of the present invention, the exhaust gas is led to flow into each individual space, and is individually led to flow into the communication pipe from the individual space. For this reason, resonance can be suppressed between the mutual exhaust pipes, a reduction in noise based on the resonance can be achieved, and a tone of exhaust noise can be successfully maintained.

According to an embodiment of the present invention, also, with regard to a multiple cylinder internal combustion engine with the resonance easily caused, the resonance can be suppressed between the mutual exhaust pipes, and the reduction in noise based on the resonance can be achieved.

According to an embodiment of the present invention, counterflow pulsation from the downstream exhaust pipes is prevented, and a straightening effect of the exhaust gas passed through the inside of the catalytic device is improved. As a result, exhaust emission control performance is improved, output of the internal combustion engine is improved, noise is reduced, and the tone of the exhaust noise is improved.

According to an embodiment of the present invention, the exhaust gas is equally led to flow into the communication pipe from the plurality of exhaust pipes. Thus, exhaust performance is improved.

According to an embodiment of the present invention, vibration of the partition plate is suppressed. Thus, sounding noise due to vibration is prevented.

According to an embodiment of the present invention, the first expansion chamber is narrowed by the relief recessed part. For this reason, broadening of the partition plate is reduced. The partition plate can be miniaturized. The sounding noise can be further suppressed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
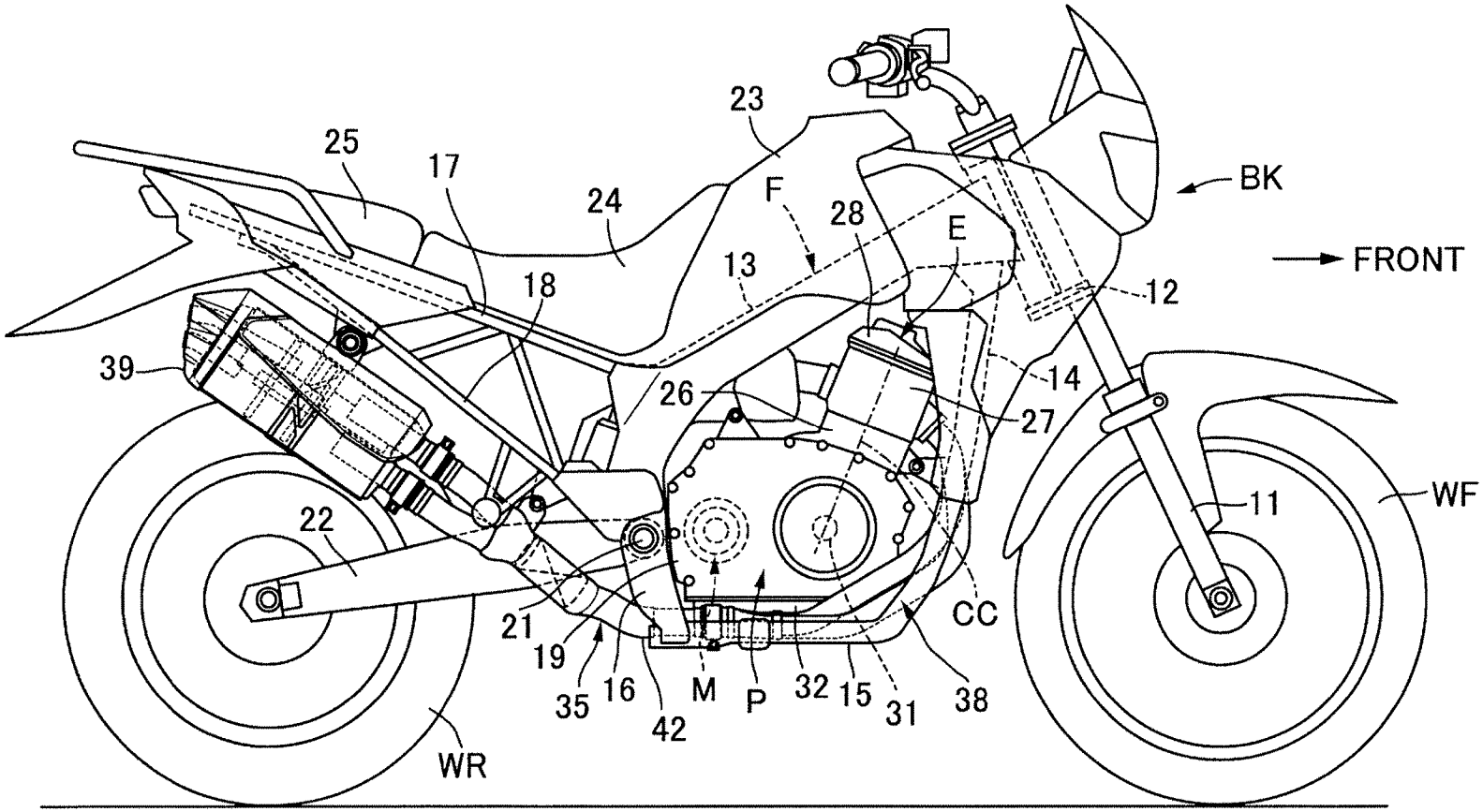
FIG. 1 is a side view schematically showing a structure of a motorcycle as one illustrative embodiment of a saddle-ride type vehicle.

FIG. 1 shows a motorcycle BK as one illustrative embodiment of a saddle-ride type vehicle. A vehicle body frame F of the motorcycle BK is provided with a head pipe 12 that steerably supports front forks 11, a pair of right and left main frames 13 that extend rearwardly and downwardly from the head pipe 12, a pair of right and left down frames 14 that extend rearwardly and downwardly at a steeper slope than the main frames 13, right and left lower frames 15 that extend rearwardly from lower ends of both the down frames 14 and a pair of right and left center frames 16 that extend downwardly from rear ends of the main frames 13 and are coupled to rear ends of the lower frames 15, a pair of right and left seat rails 17 that extend rearward and upward from the rear ends of the main frames 13. A pair of right and left rear subframes 18 that lower parts of the center frames 16 and rear parts of the seat rails 17. A front wheel WF is rotatably supported around a horizontal axis by the front forks 11.

A power unit P is supported on the vehicle body frame F. The power unit P is arranged in an area surrounded by the main frames 13, the down frames 14, the lower frames 15, and the center frames 16. The power unit P is provided with a multiple cylinder internal combustion engine E (for example, a four-cycle juxtaposed two-cylinder internal combustion engine), and a transmission M. The transmission M is housed in a crankcase 19 as a transmission case provided to the internal combustion engine E.

Front ends of swing arms 22 are vertically swingably coupled around a spindle 21 to lower parts of the center frames 16. A rear wheel WR is rotatably supported around a horizontal shaft parallel to an axis center of the spindle 21 at rear ends of the swing arms 22. The rear wheel WR is driven by power transmitted from the power unit P.

A fuel tank 23 is mounted on the main frames 13 above the internal combustion engine E. A rider seat 24 is arranged behind the fuel tank 23, and a pillion seat 25 is arranged behind the rider seat 24. The rider seat 24 and the pillion seat 25 are supported by the seat rails 17.

The internal combustion engine E is provided with the crankcase 19, a cylinder block 26, a cylinder head 27, and a head cover 28. The crankcase 19 rotatably supports a crankshaft 31 having an axis extending in a vehicle width direction. The cylinder block 26 has a forwardly inclined cylinder axis CC, and is coupled to a front upper end of the crankcase 19. The cylinder block 26 is formed with two cylinders arranged parallel to each other along the axis of the crankshaft 31. A crank angle is set to, for example, 270 degrees. The cylinder head 27 is coupled to an upper end of the cylinder block 26. The head cover 28 is coupled to an upper end of the cylinder head 27. An oil pan 32 is coupled to a lower part of the crankcase 19.

An exhaust system 35 is connected to the internal combustion engine E. The exhaust system 35 is provided with exhaust pipes 38 connected to the cylinder head 27. The exhaust pipes 38 extend from the cylinder head 27, are passed through a space below the internal combustion engine E, and are directed rearwardly of the vehicle. A muffler 39 is mounted to rear ends of the exhaust pipes 38. The exhaust pipes 38 and the muffler 39 are coupled to a rear subframe 18. In this way, the exhaust system 35 is coupled and fixed to the vehicle body frame F.

Figure 2:
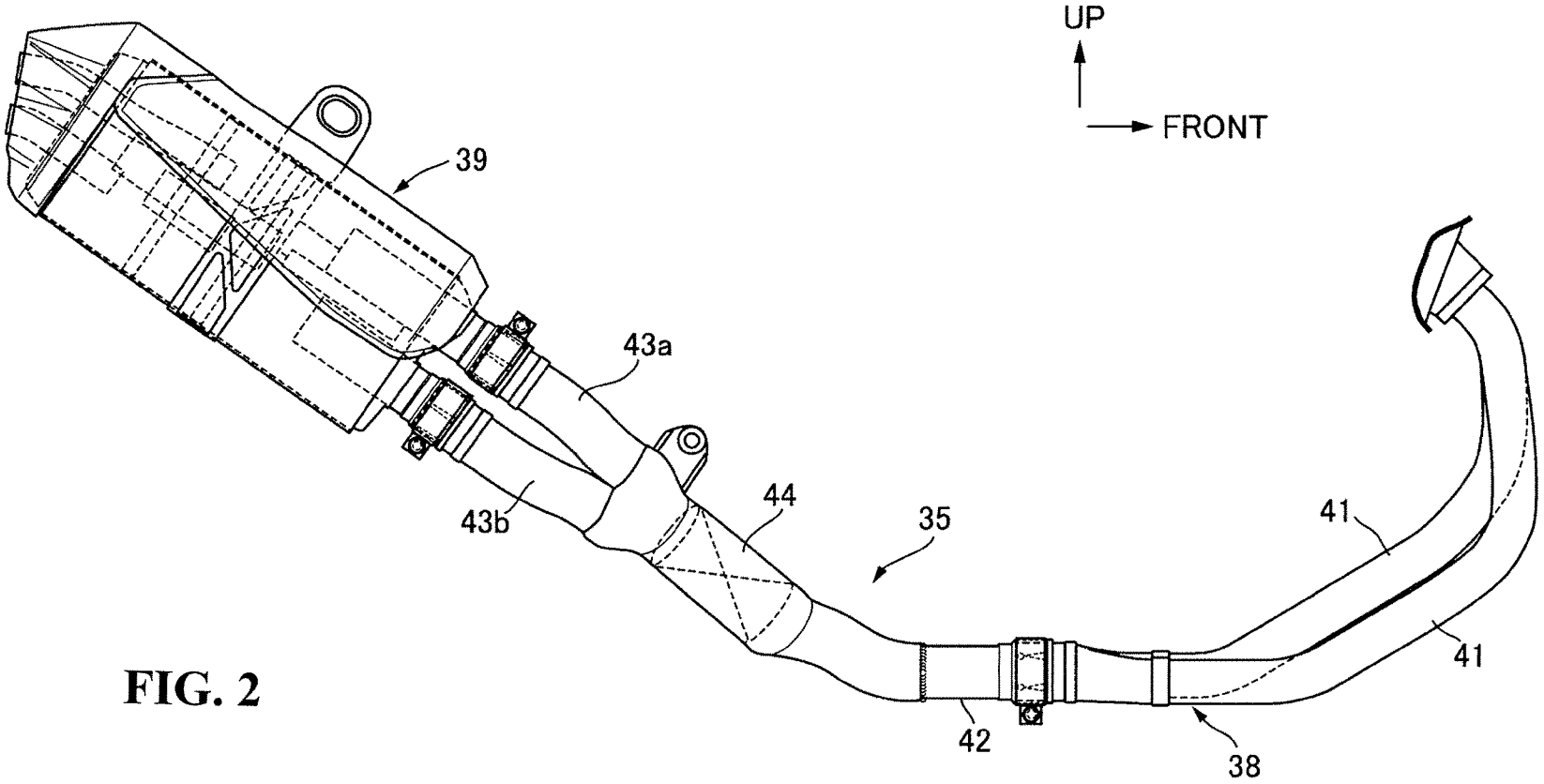
FIG. 2 is an enlarged side view schematically showing a structure of an exhaust system according to the present embodiment.

As shown in FIG. 2, each of the exhaust pipes 38 is provided with (two) upstream pipes 41 connected to a front side wall of the cylinder head 27 with respect to each of the cylinders, a common pipe 42 connected to downstream ends of the upstream pipes 41 and unifying the two upstream pipes 41, and branched pipes 43*a*, 43*b* connected to a downstream end of the common pipe 42 and branched into a plurality of branched pipes (two in this case). The exhaust gas is led to flow into the upstream pipes 41 from the two cylinders of the internal combustion engine E at different timings. A catalytic device 44 is incorporated in the common pipe 42. The catalytic device 44 commonly cleans up the exhaust gas led to flow from the two cylinders. In this way, the exhaust pipes 38 are unified, are passed through the catalytic device 44, and are branched into two at a downstream side of the catalytic device 44.

Figure 3:
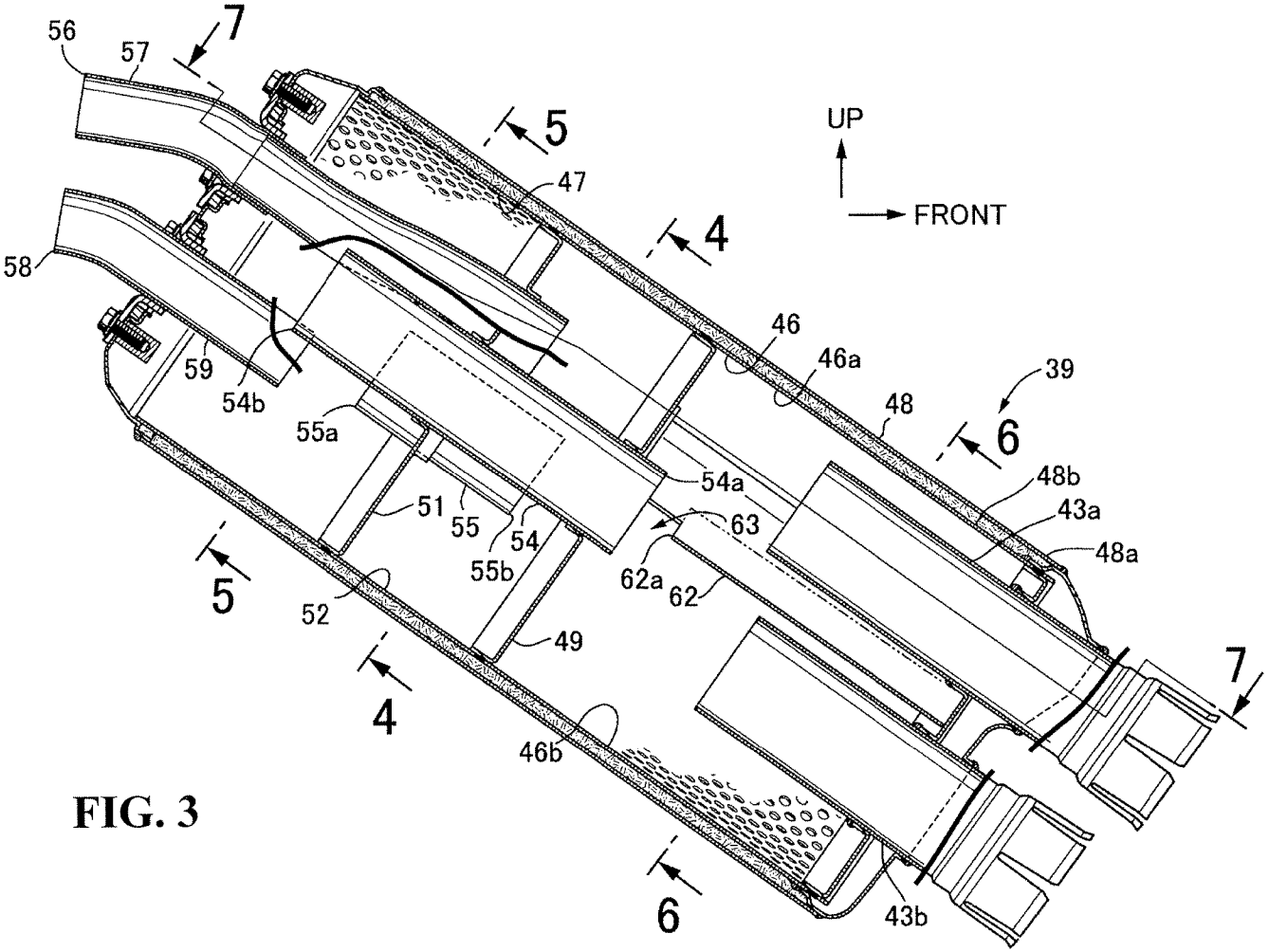
FIG. 3 is an enlarged vertical cross-sectional view schematically showing a structure of a muffler.

As shown in FIG. 3, the muffler 39 is provide with a muffler body 48 configured in such a manner that a first expansion chamber 46 and a second expansion chamber 47 separated from each other are partitioned therein. The muffler body 48 is formed of an outer cylinder 48*a*, and an inner cylinder 48*b* housed in the outer cylinder 48*a* so as to be positioned coaxially with the outer cylinder 48*a*. Glass wool, as sound absorbing material, is sandwiched between the outer cylinder 48*a* and the inner cylinder 48*b*.

The first expansion chamber 46 is partitioned as a front space in the muffler body 48 by a first partition wall 49. The second expansion chamber 47 is partitioned as a rear space in the muffler body 48 by a second partition wall 51. In the muffler body 48, the first partition wall 49 and the second partition wall 51 partition a third expansion chamber 52 between the first expansion chamber 46 and the second expansion chamber 47. The third expansion chamber 52 is separated from the first expansion chamber 46 and the second expansion chamber 47 by the first partition wall 49 and the second partition wall 51, respectively. In this way, a space in the muffler body 48 is divided into three in a longitudinal direction. The first partition wall 49 and the second partition wall 51 have only to be welded to, for example, an inner surface of the inner cylinder 48*a*.

The branched pipes 43*a*, 43*b* of each of the exhaust pipes 38 are connected to the first expansion chamber 46. The branched pipe 43*a* is entered into an upper space of the first expansion chamber 46, and is opened in the first expansion chamber 46. The branched pipe 43*b* is entered into a lower space of the first expansion chamber 46, and is opened in the first expansion chamber 46. Outflow ends of the branched pipes 43*a*, 43*b* are respectively formed into a cylindrical shape, and axial centers of the branched pipes 43*a*, 43*b* have only to extend in parallel with each other.

The muffler 39 is provided with a first communication pipe 54 connected to the first expansion chamber 46 and the second expansion chamber 47. The first communication pipe 54 is penetrated through the third expansion chamber 52. The first communication pipe 54 is supported in the muffler body 48 by the first partition wall 49 and the second partition wall 51. The first communication pipe 54 has an inflow end 54*a* opened in the first expansion chamber 46 and an outflow end 54*b* opened in the second expansion chamber 47. The first communication pipe 54 has only to be formed into a cylindrical shape, and an axial center of the first communication pipe 54 has only to be arranged in parallel to the axial centers of the branched pipes 43*a*, 43*b*. The exhaust gases from the branched pipes 43*a*, 43*b* are merged in the first communication pipe 54, and the merged exhaust gas is introduced into the second expansion chamber 47.

The muffler 39 is provided with a second communication pipe 55 connected to the third expansion chamber 52 while communicating with the second expansion chamber 47. The second communication pipe 55 is penetrated through the second partition wall 51. The second communication pipe 55 has only to be supported in the muffler body 48 by the second partition wall 51. The second communication pipe 55 has an inflow end 55*a* entered into the second expansion chamber 47 and opened in the second expansion chamber 47, and an outflow end 55*b* entered into the third expansion chamber 52 and opened in the third expansion chamber 52. The second communication pipe 55 has only to be formed into a cylindrical shape, and the axial center of the second communication pipe 55 has only to be arranged in parallel to the axial center of the first communication pipe 54. In this way, the exhaust gas in the second expansion chamber 47 can be introduced into the third expansion chamber 52.

Figure 4:
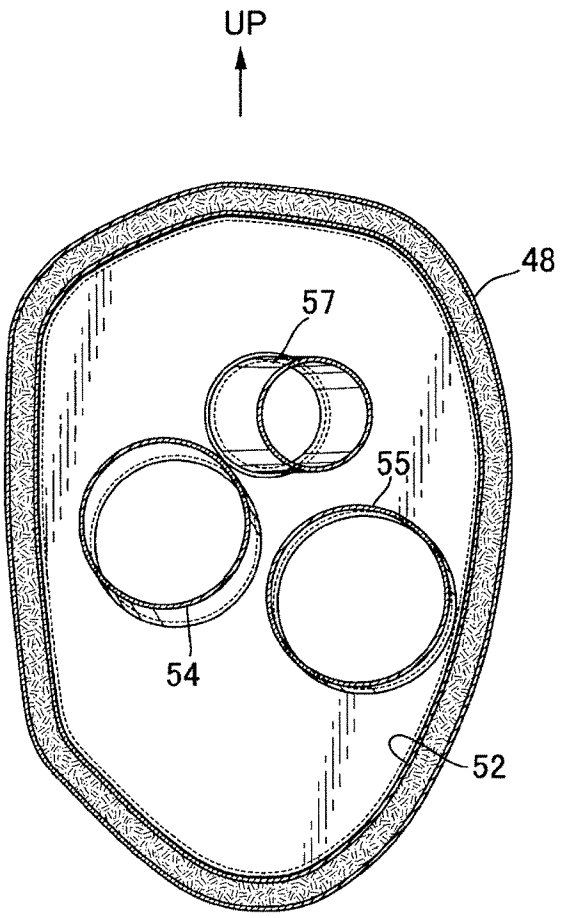
FIG. 4 is a cross-sectional view taken along line 4-4 in FIG. 3.

The muffler 39 is provided with a first outlet pipe 57 connected to the third expansion chamber 52 and forming a first exhaust port 56 on an outer side of the muffler body 48. The first outlet pipe 57 extends toward the first exhaust port 56 through the second expansion chamber 47 from an inflow end entered into the third expansion chamber 52 and opened in the third expansion chamber 52. The inflow end of the first outlet pipe 57 is arranged rearwardly of the outflow end 55*b* of the second communication pipe 55. The first outlet pipe 57 has only to be supported by the second partition wall 51 and the rear end wall of the muffler body 48. The exhaust gas introduced into the second expansion chamber 47 is led to flow into the third expansion chamber 52 through the second communication pipe 55, and can be discharged to the outside of the muffler body 48 through the first outlet pipe 57 from the third expansion chamber 52. As shown in FIG. 4, the first communication pipe 54, the second communication pipe 55, and the first outlet pipe 57 are arranged apart from each other in the third expansion chamber 52 without interfering with each other. Note that each diameter of the first communication pipe 54 and the second communication pipe 55 is larger than the diameter of the first outlet pipe 57.

Figure 5:
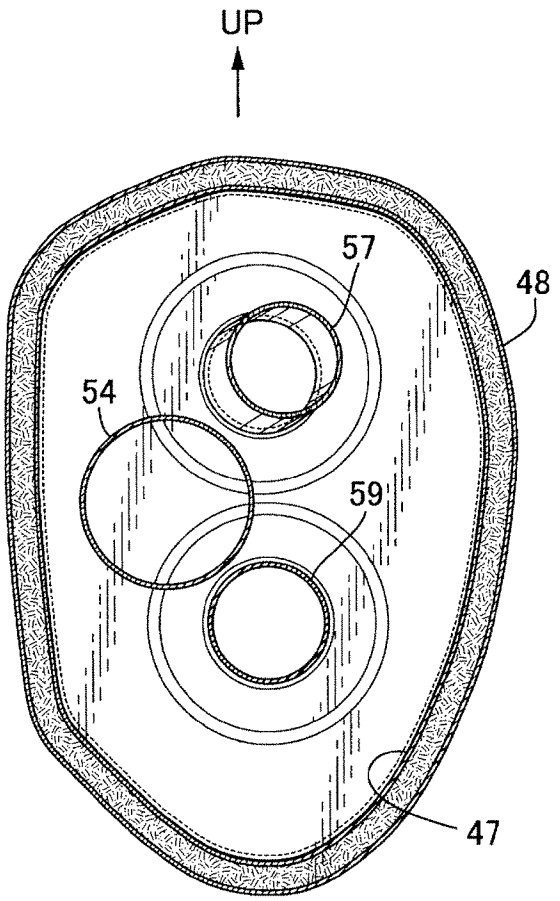
FIG. 5 is a cross-sectional view taken along line 5-5 in FIG. 3.

The muffler 39 is provided with a second outlet pipe 59 connected to the second expansion chamber 47 and forming a second exhaust port 58 on the outer side of the muffler body 48. The second outlet pipe 59 extends toward the second exhaust port 58 through a rear end wall of the muffler body 48 from an inflow end entered into the second expansion chamber 47 and opened in the second expansion chamber 47. Note that the inflow end of the second outlet pipe 59 is arranged forward of the outflow end of the first communication pipe 54. The second outlet pipe 59 has only to be supported by the rear end wall of the muffler body 48. The exhaust gas introduced into the second expansion chamber 47 can be discharged to the outside of the muffler body 48 through the second outlet pipe 59 from the second expansion chamber 47. As shown in FIG. 5, the first communication pipe 54, the first outlet pipe 57, and the second outlet pipe 59 are arranged apart from each other in the second expansion chamber 47 without interfering with each other. Note that a diameter of the first communication pipe 54 is larger than the diameter of each of the first outlet pipe 57 and the second outlet pipe 59. As can been seen in FIG. 4, the diameter of the first communication pipe 54 is larger than the diameter of the second communication pipe 55. As a result, the diameter of the second communication pipe 55 is larger than the diameter of the second outlet pipe 59.

A partition plate 62 is arranged in the first expansion chamber 46. The first expansion chamber 46 is partitioned into each individual space (an upper space 46*a* and a lower space 46*b*) with respect to each of the branched pipes 43*a*, 43*b* by the partition plate 62. The partition plate 62 extends in parallel to (for example, in parallel with) the axial center of the first communication pipe 54. A part of an end surface 62*a* of the partition plate 62 is placed opposite to the inflow end 54*a* at a predetermined distance from the inflow end 54*a* of the first communication pipe 54. Therefore, a notch 63 for allowing the upper space 46*a* and the lower space 46*b* to communicate with each other is formed between the inflow end 54*a* and the partition plate 62. The end surface 62*a* for partitioning the notch 63 is arranged rearwardly of the outflow ends of the branched pipes 43*a*, 43*b*.

Figure 6:
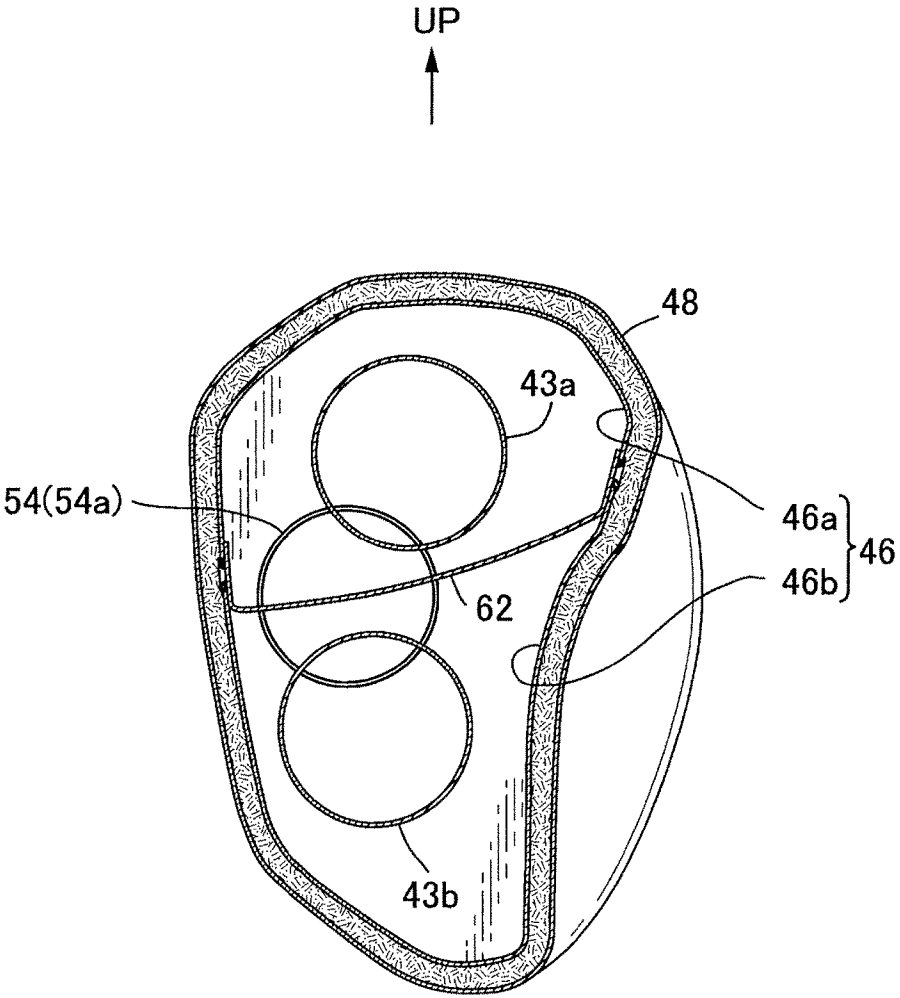
FIG. 6 is a cross-sectional view taken along line 6-6 in FIG. 3.

As shown in FIG. 6, the partition plate 62 is arranged in a position for bifurcating an outflow port (inflow end 54*a*) of the first communication pipe 54. When the partition plate 62 is arranged, a periphery of the partition plate 62 has only to be welded to an inner surface of the inner cylinder 48*b* of the muffler body 48. The partition plate 62 is formed of, for example, curved plate material. A generating line of a curved surface has only to be arranged in parallel to, for example, the axial center of the first communication pipe 54.

If the internal combustion engine E is operated now, the exhaust gas is discharged at different timings from the plurality of cylinders of the internal combustion engine E. The exhaust gas is introduced into the muffler 39 from the exhaust pipe 38. The unified exhaust pipe 38 is passed through the catalytic device 44, and is branched into the plurality of branched pipes 43*a*, 43*b* on the downstream side of the catalytic device 44. For this reason, counterflow pulsation from the downstream exhaust pipes is prevented, and a straightening effect of the exhaust gas passed through the inside of the catalytic device 44 is improved. As a result, exhaust emission control performance is improved, output of the internal combustion engine E is improved, noise is reduced, and the tone of the exhaust noise is improved.

The exhaust gas is introduced from the branched pipes 43*a*, 43*b* into the single first expansion chamber 46. The exhaust gases are merged in the first expansion chamber 46, and the merged exhaust gas is introduced into the second expansion chamber 47 through the common first communication pipe 54. Therefore, in comparison with the case with the muffler configured with respect to each of the branched pipes 43*a*, 43*b*, the exhaust system 35 can be miniaturized. Also, after the exhaust gases are merged, the structure of each of the second communication pipe 55, the third expansion chamber 52, the first outlet pipe 57 and the second outlet pipe 59 is used in common between the plurality of branched pipes 43*a*, 43*b*. For this reason, it can contribute to a reduction in the number of components.

When the exhaust gases are merged, the exhaust gas is led to flow into the individual space (the upper space 46*a* and the lower space 46*b*) from the branched pipes 43*a*, 43*b*, and is individually led to flow into the first communication pipe 54 from the upper space 46*a* and the lower space 46*b*. Therefore, resonance can be suppressed between the branched pipes 43*a*, 43*b*, the reduction in noise based on the resonance can be achieved, and the tone of the exhaust noise can be successfully maintained.

In the second expansion chamber 47, the outflow end 54*b* of the first communication pipe 54 is positioned rearwardly of the inflow end of the second outlet pipe 59. Therefore, the exhaust gas is not led to flow into the second outlet pipe 59 directly from the first communication pipe 54, and spouts toward the rear end wall of the muffler body 48. In addition, the diameter of the second communication pipe 55 is larger than that of the second outlet pipe 59. Thereby, the exhaust gas is easily led to flow into the second communication pipe 55. In this way, the exhaust gas is introduced into the third expansion chamber 52 from the second expansion chamber 47. The exhaust gas is discharged to the outside through the first outlet pipe 57 from the third expansion chamber 52.

In the muffler body 48, when the first expansion chamber 46 and the second expansion chamber 47 are connected to each other, the first communication pipe 54 is penetrated through the third expansion chamber 52. As a result, the length of the first communication pipe 54 is sufficiently ensured. Thus, the silencing effect is enhanced. In addition, the length of the flow path for the exhaust gas is further ensured by action of the first outlet pipe 57. Thus, the silencing effect is further enhanced. Further, the first communication pipe 54 and the first outlet pipe 57 are respectively penetrated through the third expansion chamber 52 and the second expansion chamber 47. For this reason, the miniaturization of the exhaust system 35 is maintained.

As has been previously described, the exhaust gas is led to flow into the first expansion chamber 46 at the different timings from the plurality of cylinders of the internal combustion engine E. Also with respect to the multiple cylinder internal combustion engine E that easily causes resonance, the resonance can be suppressed between the exhaust pipes. Thus, a reduction in noise based on the resonance can be achieved.

In the muffler 39, the partition plate 62 is arranged in the first expansion chamber 46. The exhaust gas is equally led to flow into the first communication pipe 54 from the branched pipes 43*a*, 43*b*. As a result, exhaust performance is improved. In addition, the partition plate 62 is formed of the curved plate material, and the vibration of the partition plate 62 is suppressed. Thus, a noise due to the vibration is prevented.

Figure 7:
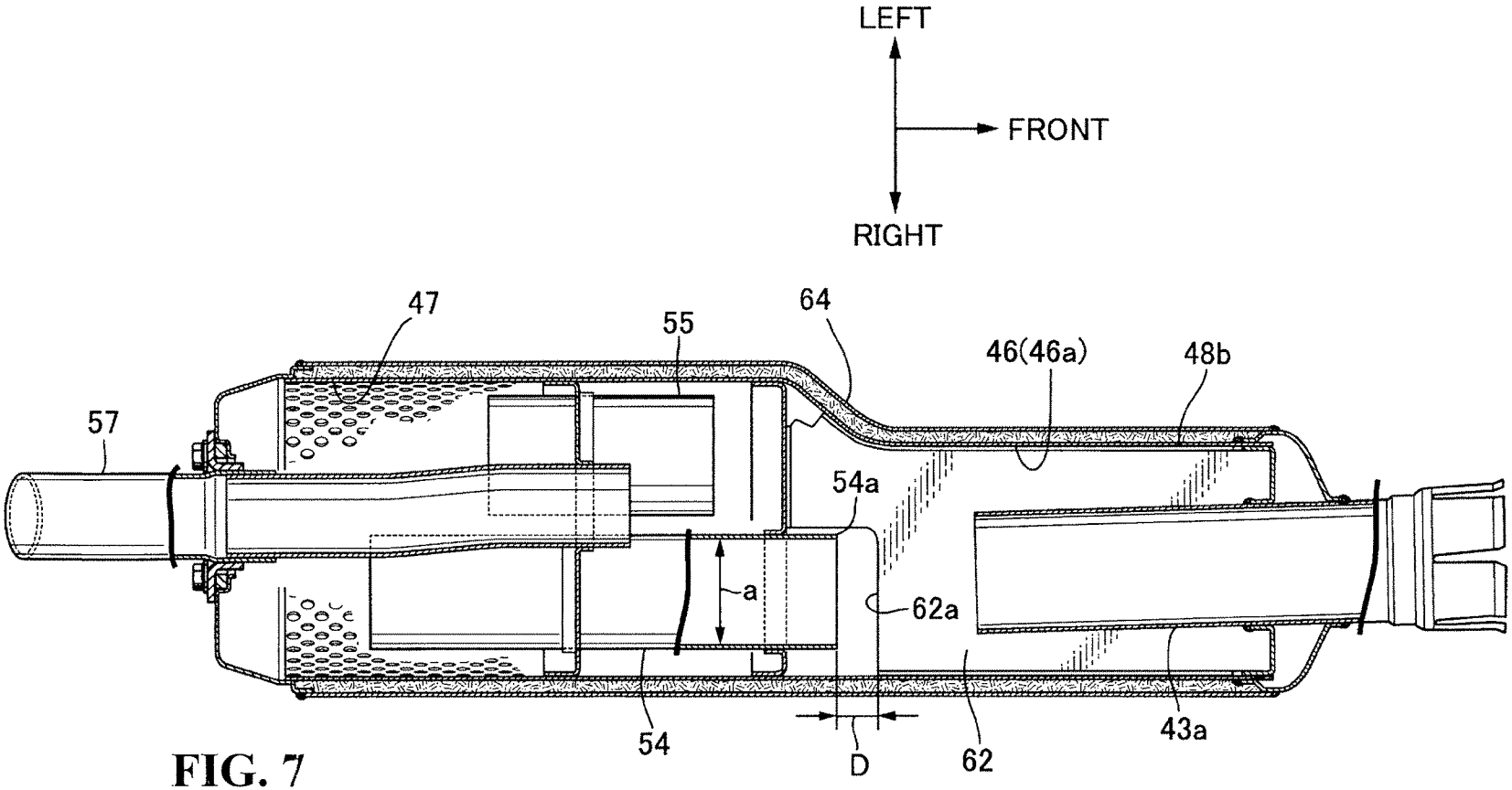
FIG. 7 is a cross-sectional view taken along line 7-7 in FIG. 3.

As shown in FIG. 7, a distance D between the inflow end 54*a* of the first communication pipe 54 and the end surface 62*a* of the partition plate 62 is set shorter than or equal to one-half of an inside diameter a of the first communication pipe 54. By the above-described structure, mutual interference between the exhaust gas flowing in the upper space 46*a* and the exhaust gas flowing in the lower space 46*b* can be prevented.

As shown in FIG. 7, the muffler body 48 is formed with a relief recessed part 64 that is formed in a specified space occupied by the rear wheel WR when attached to the motorcycle BK and recessed toward the first expansion chamber 46. The first expansion chamber 46 is narrowed in the vehicle width direction by the relief recessed part 64. When one end of the partition plate 62 is welded and fixed to the inner cylinder 48*b* of the muffler body 48 on the inner side of the relief recessed part 64, broadening of the partition plate 62 is reduced. Thus, the partition plate 62 can be miniaturized and the noise can be further suppressed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust system comprising:

a muffler body configured wherein a first expansion chamber and a second expansion chamber are separated from each other with at least a partition therebetween, and a plurality of exhaust pipes extending from an internal combustion engine are connected to the first expansion chamber;

a communication pipe operatively connected to the first expansion chamber and the second expansion chamber, to merge exhaust gas from the plurality of exhaust pipes, and to introduce the merged exhaust gas into the second expansion chamber; and a partition plate arranged inside of the first expansion chamber, for partitioning the first expansion chamber with respect to each of the exhaust pipes in order to partition each individual space, and having an end surface opposed to an inflow port of the communication pipe, wherein the partition plate is arranged in a position extending substantially in parallel to an axial center of the communication pipe and bifurcating the inflow port of the communication pipe.

2. The exhaust system according to claim 1, wherein:

the muffler body is configured wherein a third expansion chamber is partitioned between the first expansion chamber and the second expansion chamber; and a second communication pipe communicating with the second expansion chamber and an outlet pipe penetrating through the second expansion chamber in order to form an exhaust port are connected to the third expansion chamber.

3. The exhaust system according to claim 1, wherein the exhaust gas is led to flow into the first expansion chamber from a plurality of cylinders of the internal combustion engine at different timings.

4. The exhaust system according to claim 3, wherein the exhaust pipes are passed through a catalytic device after being unified, and branched into the plurality of exhaust pipes at a downstream side of the catalytic device.

5. The exhaust system according to claim 1, wherein the partition plate is formed of curved plate material.

6. The exhaust system according to claim 3, wherein the partition plate is formed of curved plate material.

7. The exhaust system according to claim 4, wherein the partition plate is formed of curved plate material.

8. The exhaust system according to claim 1, wherein the muffler body is provided with a relief recessed part that is formed in a specified space occupied by a rear wheel when attached to a saddle-ride vehicle and recessed toward the first expansion chamber; and one end of the partition plate is welded to an inner wall surface of the relief recessed part.

9. The exhaust system according to claim 3, wherein the muffler body is provided with a relief recessed part that is formed in a specified space occupied by a rear wheel when attached to a saddle-ride vehicle and recessed toward the first expansion chamber; and one end of the partition plate is welded to an inner wall surface of the relief recessed part.

10. The exhaust system according to claim 4, wherein the muffler body is provided with a relief recessed part that is formed in a specified space occupied by a rear wheel when attached to a saddle-ride vehicle and recessed toward the first expansion chamber; and one end of the partition plate is welded to an inner wall surface of the relief recessed part.

11. The exhaust system according to claim 5, wherein the muffler body is provided with a relief recessed part that is formed in a specified space occupied by a rear wheel when attached to a saddle-ride vehicle and recessed toward the first expansion chamber; and one end of the partition plate is welded to an inner wall surface of the relief recessed part.

12. An exhaust system comprising:

a muffler body having:

a first expansion chamber;

a second expansion chamber, said first expansion chamber being separated from said second expansion chamber by at least a partition therebetween;

a plurality of exhaust pipes adapted to extend from an internal combustion engine, said plurality of exhaust pipes being connected to the first expansion chamber;

a communication pipe operatively connected to the first expansion chamber and the second expansion chamber, to merge exhaust gas from the plurality of exhaust pipes, and to introduce the merged exhaust gas into the second expansion chamber; and a partition plate arranged inside of the first expansion chamber, for partitioning the first expansion chamber with respect to each of the exhaust pipes in order to partition each individual space, and having an end surface opposed to an inflow port of the communication pipe, wherein the partition plate is arranged in a position extending substantially in parallel to an axial center of the communication pipe and bifurcating the inflow port of the communication pipe.

13. The exhaust system according to claim 12, wherein:

the muffler body includes:

a third expansion chamber, said third expansion chamber being partitioned between the first expansion chamber and the second expansion chamber; and a second communication pipe communicating with the second expansion chamber and an outlet pipe penetrating through the second expansion chamber in order to form an exhaust port are connected to the third expansion chamber.

* * * * *